343-700 MS AU 256 EX
12/25/79 OR 4,180,818

United States Patent [19]
Schwartz et al.

[11] 4,180,818
[45] Dec. 25, 1979

[54] DOPPLER NAVIGATION MICROSTRIP SLANTED ANTENNA

[75] Inventors: Leonard Schwartz, Montville, N.J.; Edward Chin, New York; Emile J. Deveau, Pleasantville, both of N.Y.

[73] Assignee: The Singer Company, Little Falls, N.J.

[21] Appl. No.: 876,973

[22] Filed: Feb. 13, 1978

[51] Int. Cl.[2] ..... H01Q 1/28
[52] U.S. Cl. ..... 343/700 MS; 343/705; 343/853
[58] Field of Search ..... 343/700 MS, 771, 829, 343/846, 853, 9, 705

[56] References Cited

U.S. PATENT DOCUMENTS

| | | | |
|---|---|---|---|
| 3,249,946 | 5/1966 | Flanagan | 343/792.5 |
| 3,423,752 | 1/1969 | Schwartz | 343/771 |
| 3,508,275 | 4/1970 | Deveau et al. | 343/771 |
| 3,832,716 | 8/1974 | Plunk et al. | 343/846 |
| 3,995,277 | 11/1976 | Olyphant | 343/700 MS |
| 4,119,971 | 10/1978 | Stark | 343/771 |
| 4,120,085 | 10/1978 | Peterson | 343/771 |

FOREIGN PATENT DOCUMENTS

| | | | |
|---|---|---|---|
| 1385905 | 3/1975 | United Kingdom | 343/771 |

*Primary Examiner*—Eli Lieberman
*Attorney, Agent, or Firm*—Thomas W. Kennedy

[57] ABSTRACT

In order to provide improved performance in a printed antenna, particularly for use in a Doppler navigation system, two pairs of linear arrays slanted at 45° are utilized to obtain a beam shape which exhibits a degree of independence from over-water shift with the two sets of arrays constructed respectively as forward and backward firing arrays in order to compensate for frequency changes.

9 Claims, 11 Drawing Figures

BACK SCATTERING, LAND & WATER

POWER SPECTRUM OF DOPPLER ECHO

ANTENNA CONTOURS FOR A γ-Ψ ANTENNA

3DB ANTENNA PATTERN OF A $\gamma$-$\sigma$ ANTENNA $$PL = (L + S1 + \frac{2}{\lambda} S2 + S3 + S4)$$

$$\delta = \frac{2\pi}{\lambda_0}\sqrt{\epsilon}\, PL$$

$$\frac{2\pi}{\lambda_0} s \cos\gamma - \delta = 0, \pm 2\pi, \ldots$$

DOPPLER NAVIGATION MICROSTRIP SLANTED ANTENNA

BACKGROUND OF THE INVENTION

This invention relates to micro-wave antennas in general and more particularly to an improved micro-wave antenna particularly useful in Doppler navigation systems.

A common problem in Doppler navigation antennas is what is known as over-water shift. Because of the different characteristics of returned energy from land and water, in the typical Doppler system, a shift occurs when flying over water which can lead to considerable error. One manner of overcoming this is what is known as a beam lobing technique in which each of the Doppler beams are alternated between two positions, a few degrees apart. Although such an approach has been found workable, it requires additional hardware and additional time. Another approach is that disclosed in U.S. Pat. No. 2,983,920 granted to R. H. Rearwin and assigned to the same assignee as the present invention. Disclosed therein is a planar array of micro-wave antennas which are slanted at 45° to permit generating a beam shape which exhibits a high degree of independence from over-water shift. However, the implementation disclosed therein is not particularly practical.

Another problem encountered in antennas of this nature is an error caused by changes in frequency. This is a particular problem in printed antennas which are finding widespread use today because of their simplicity and low cost.

Thus, the need for an improved antenna of this nature which is not sensitive to over-water shift and is insensitive to frequency, becomes apparent.

SUMMARY OF THE INVENTION

The present invention provides a solution to this problem in a printed antenna such as a micro-strip antenna. This is accomplished first by obtaining beam shaping in a printed antenna which is essentially the same as that of the aforementioned U.S. Patent and by constructing the antenna so as to contain both forward and backward firing arrays to compensate for frequency changes. Furthermore, the present invention utilizes an improved construction technique in the printed antenna which results in having the maximum possible number of elements in the smallest space in order to optimize the antenna efficiency.

Although particularly adapted to printed antennas, the use of forward and backward firing arrays for the purpose of frequency compensation can also be applied to other types of antenna arrays. In addition, the construction technique which results in being able to select an arbitrary spacing between elements, which spacing is the smallest practical, is applicable not only to antennas of the type disclosed herein, but is applicable to printed antennas in general.

DETAILED DESCRIPTION OF THE INVENTION

Prior to describing in detail the present invention, some general information concerning the problem which is solved, will be set out.

Figure 1A:
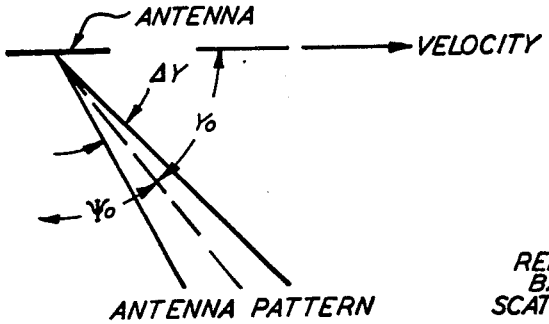
FIG. 1*a* is a diagram illustrating over-water shift.
Figure 1B:
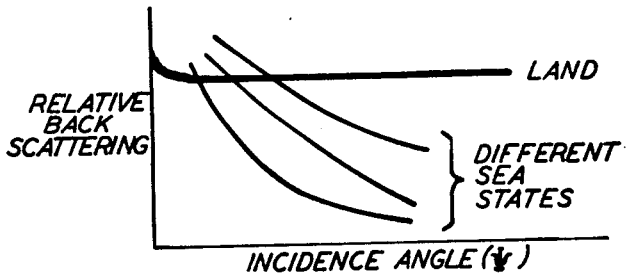
FIG. 1*b* is a diagram of the spectrum resulting from over-water shift.
Figure 1C:
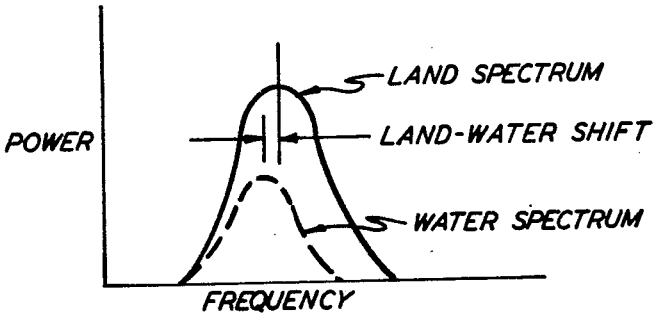
FIG. 1*c* is a further diagram illustrating beam width as a function of $\Delta\gamma$.

Regardless of the technique used to track the Doppler echo, all Doppler radars will experience a land-water shift unless specific effort is taken in the design to eliminate this shift. To discuss the mechanism of the land-water shift, consider a simple single-beam system where $\gamma_0$ (the angle between the velocity vector and the center of the radiated beam) and $\psi_0$ (the incidence angle of the beam on to the scattering surface) are in the same plane and are complementary, as shown in FIG. 1*a*. The antenna beam width is labeled $\Delta\gamma$. Over land, the uniform backscattering (FIG. 1*b*) results in a spectrum whose center is a function of $\gamma_0$ and whose width is a function of $\Delta\gamma$ (FIG. 1*c*). When flying over water, the backscattering is non-uniform as shown in FIG. 1*b* with the large $\psi$ angles (small $\gamma$ angles) having a lower scattering coefficient. Since the smaller angles are associated with the higher frequencies of the Doppler spectrum, the latter are attenuated with respect to the lower frequencies thereby shifting the spectrum peak to a lower frequency. The land-water shift generally is from 1 percent to 3 percent depending on the antenna parameters.

Figure 2A:
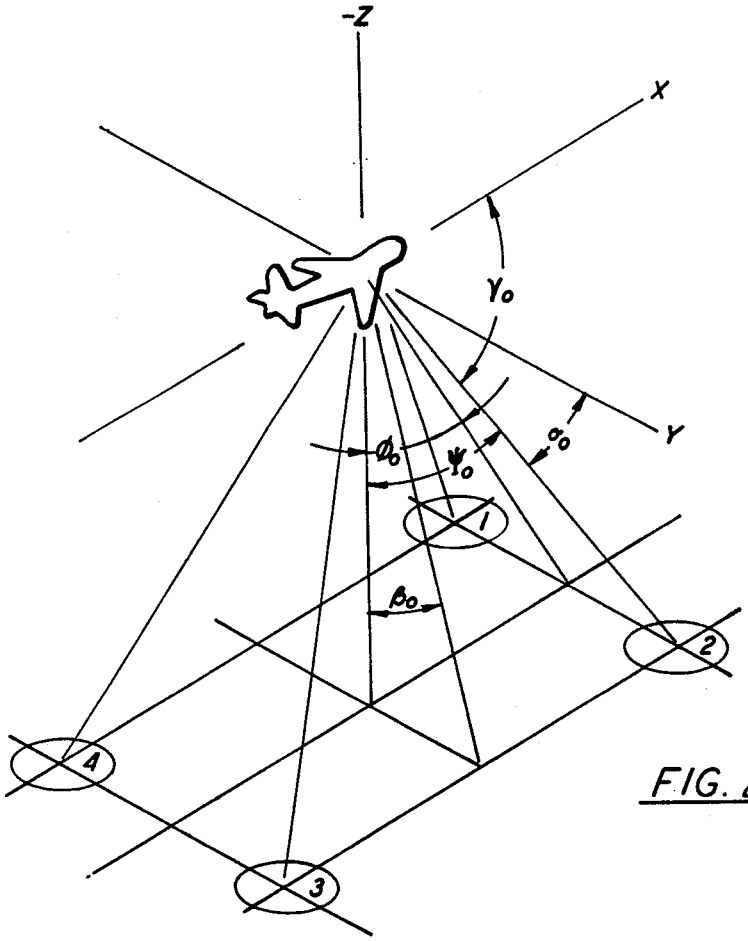
FIGS. 2*a* and 2*b* show the 3 dB contour for a beam squinted forward and to the right for an unslanted antenna.
Figure 2B:
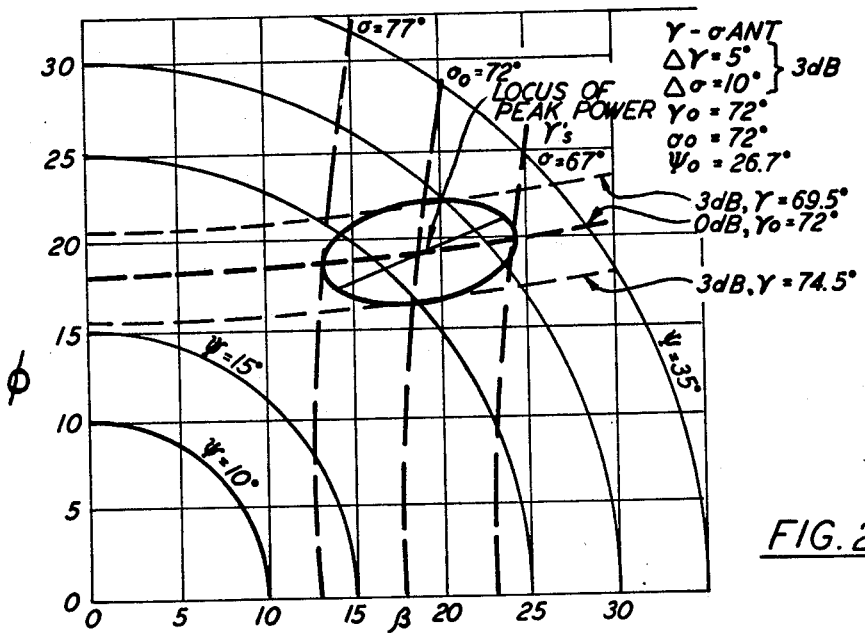

When the pattern is such that the beam is squinted and $\gamma_0$ and $\psi_0$ do not lie in the same plane, the mechanism, although essentially the same, is more difficult to visualize. A typical four beam system of this nature showing all the angles involved is illustrated by FIG. 2*a*. This would be generated typically by a rectangular array antenna. One of the beams is a beam 2 squinted forward and to the right. FIG. 2*b* shows the 3-dB contour for the beam parameters of this beam discussed above in connection with FIGS. 1*a–c*. Such an array will generate a $\gamma$-$\rho$ pattern, that is, a pattern which can be defined as the product of a function of $\gamma$ only and a function of $\rho$ only. If a series of incremental $\psi$ slices are taken across the beam, the locus of the peak power $\gamma$ angles will move from smaller $\gamma$ to larger $\gamma$ as $\psi$ is varied from large to small values, as shown in FIG. 2*b*. Thus, the peak power $\gamma$ angle varies with $\psi$ angle. Since the scattering coefficient over water varies with $\psi$ angle, it follows that the effective $\gamma$ angle as determined by integrating across all $\psi$ angles will be increased over water with respect to the land condition. This change in the effective $\gamma$ angle is the direct cause of the land-water shift.

Figure 3:
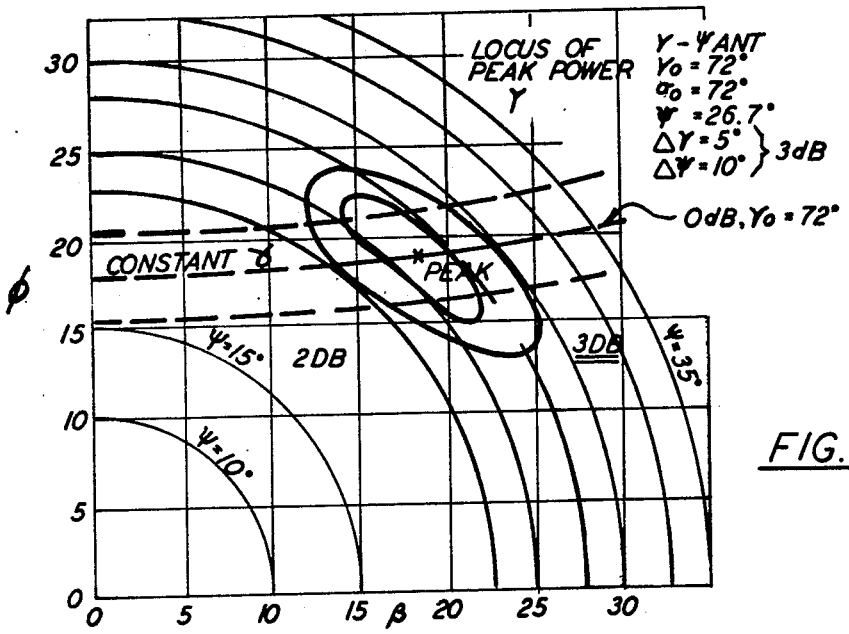
FIG. 3 shows the 3 dB contour of a slanted array antenna with the same general beam geometry.

FIG. 3 represents the 3-dB contour of a slanted array antenna pattern with the same general beam geometry as in FIGS. 2*a* and 2*b*. If the pattern in FIG. 3 is separable in $\gamma$ and $\psi$ a series of incremental $\psi$-angles will result in $\gamma$-patterns that differ in amplitude only, but the $\gamma$ pattern shapes, peaks, centers, beamwidth, etc., will be identical. As $\psi$ is varied, the locus of the peak power angle follows a constant $\gamma$ line. If all $\psi$ slices have the same peak power $\gamma$, the effective $\gamma$ (as determined by the integral of the $\psi$ slices) will be independent of any non-uniform backscattering as a function of angle. Thus, a pure $\gamma$-$\psi$ antenna will rigorously eliminate the land-water shift generally associated with Doppler radars. The pattern of the slanted planar array antenna, while not a pure $\gamma$-$\psi$ pattern, is a close enough approximation to result in negligible land-water shift in the along-heading component of velocity.

Figure 4:
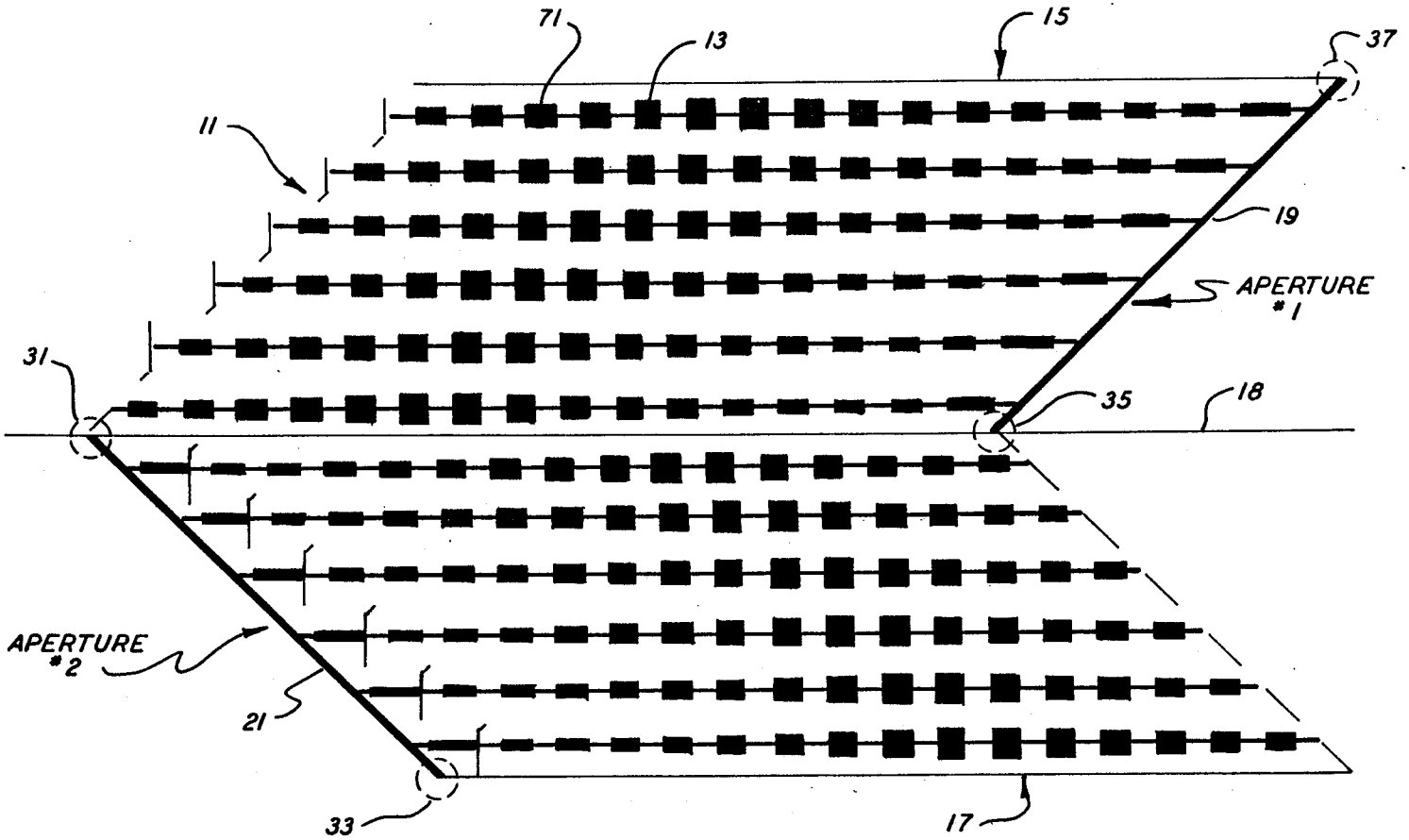
FIG. 4 is a plan view of a first embodiment of an antenna according to the present invention.

As a result, an anntenna to satisfy the requirements placed on the present invention constructed in a printed form, must appear generally like the antenna of 11 of FIG. 4. The details of the antenna will be discussed in much more detail below. However, it should noted that in general, the antenna comprises a plurality of printed arrays 13 arranged in a left group or aperture 15 and a right group or aperture 17 slanted 45° in opposite directions to the antenna axis 18. The arrays are fed from linear (series) feed lines 19 and 21 respectively. The antenna of FIG. 4, having the two slanted groups of arrays 15 and 17 which are always required to generate four properly shaped beams, is such that each of the two groups of slanted arrays, 15 and 17, generates beams in diagonal quadrants.

If the included $\gamma$-angle between the two left or right pairs can be kept constant over frequency, frequency compensation will be accomplished.

It is possible in such an antenna to obtain both forward and backward firing beams. What is meant by forward and backward firing beams is demonstrated by FIG. 5. A forward firing array is an array which has a beam pointing in the direction in which the input energy is fed. A backward firing array is one in which the beam points in a direction opposite to the direction of input energy.

Figure 6:
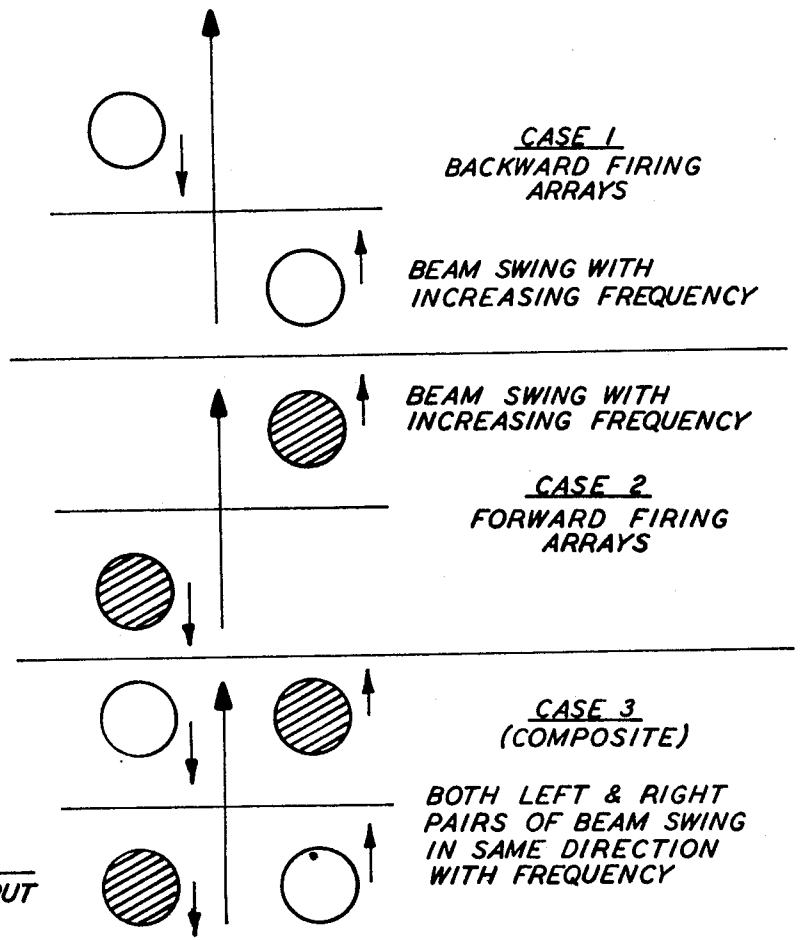
FIG. 6 illustrates the manner in which frequency compensation is accomplished by using forward and backward firing arrays.
Figure 5:
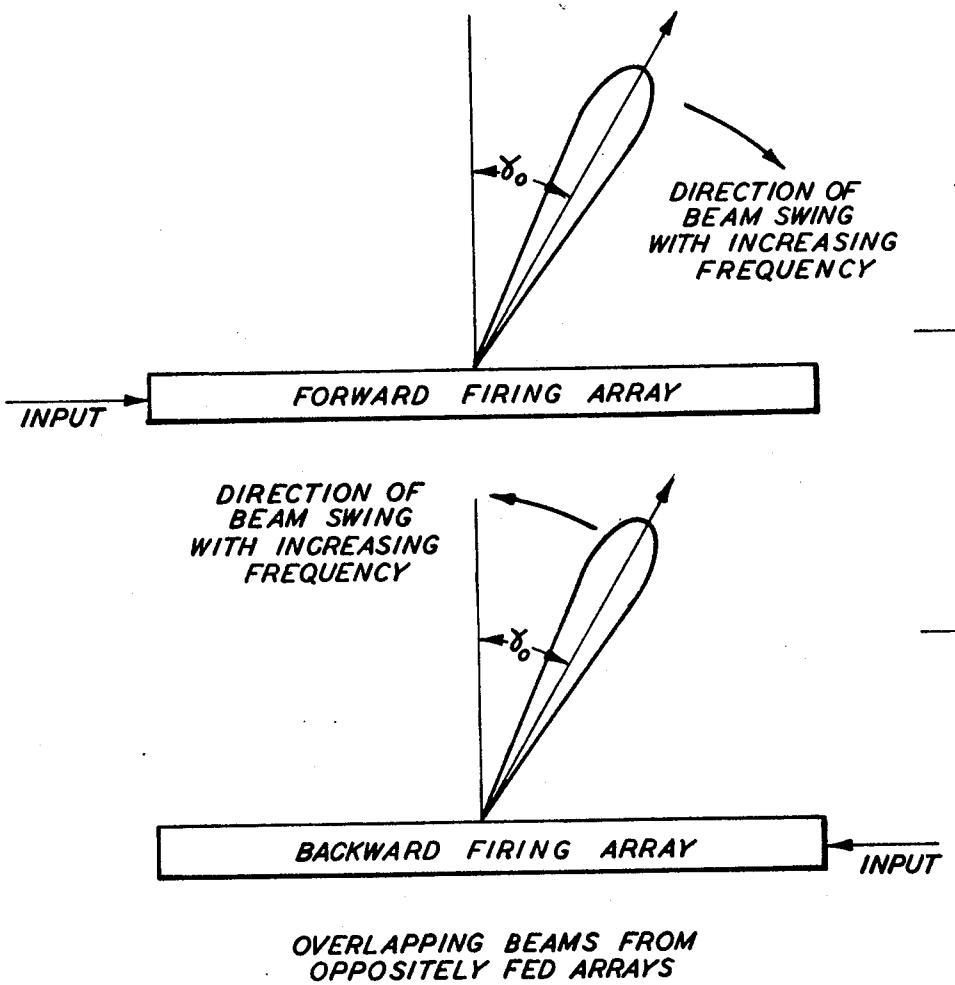
FIG. 5 is a diagram illustrating forward and backward firing arrays.

As shown in FIG. 5, as the frequency changes, the beams of forward and backward firing arrays will move in opposite directions. Frequency compensations can be accomplished by using forward firing radiating arrays in the left aperture 15 and backward firing arrays in the right aperture 17. Since pairs of diagonal beams are radiated from a given aperture, the pair of beams on both the left and right sides would be frequency compensated since the included angle on either side will be constant over frequency. This is illustrated in FIG. 6. Note that in this approach, the beam asymmetry between the left and right pairs of beams would vary with frequency although the included angle between fore-aft beams would not.

The above discussion assumed that the frequency sensitivity for both forward firing and backward firing arrays are identical. However, this is not always the case. Despite this, studies have shown that sufficient accuracy can be obtained with this arrangement.

Figure 7:
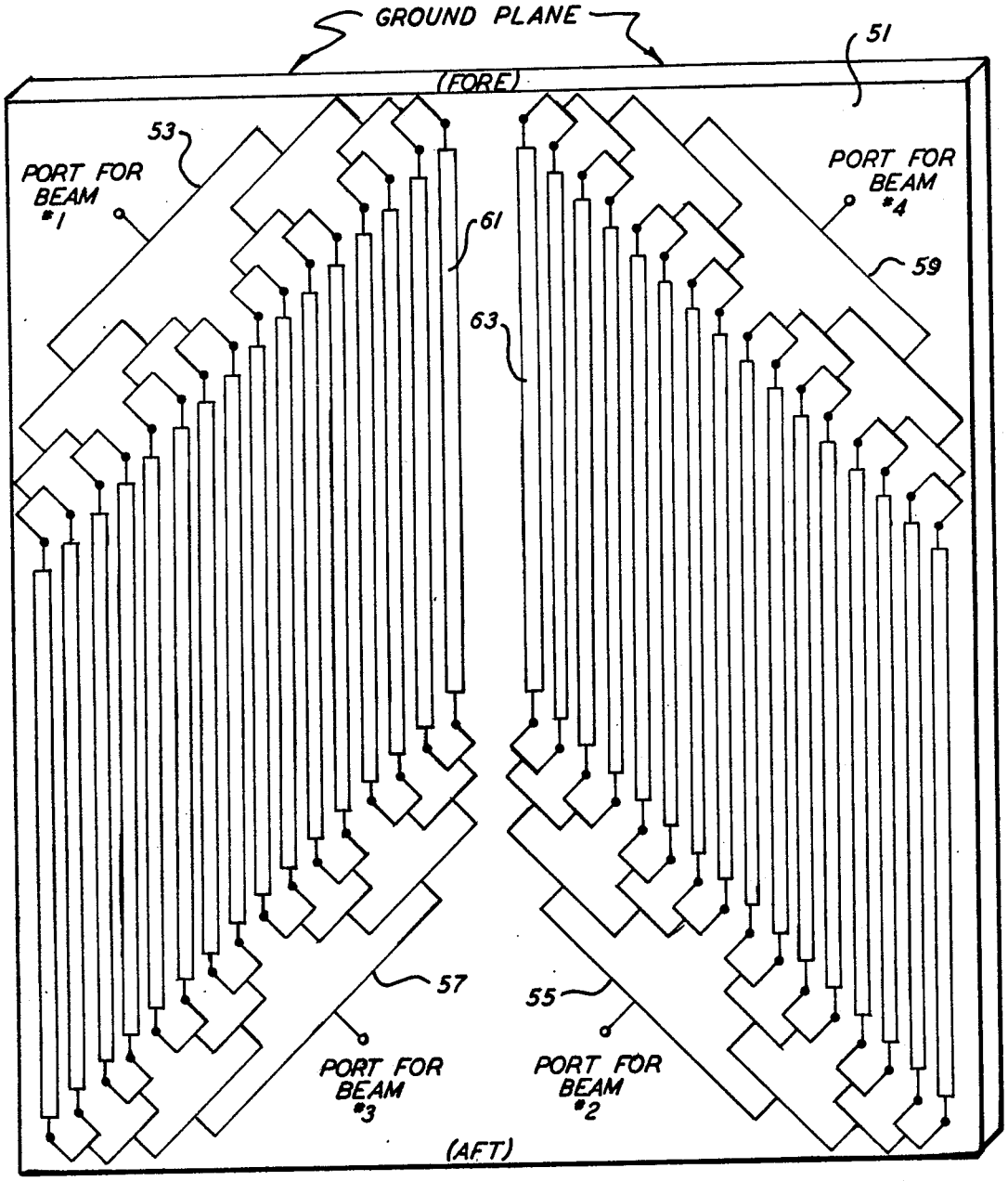
FIG. 7 is a plan view of a second embodiment of the present invention.

Returning to FIG. 4, it should be noted that the antenna shown thereon is one having a series feed. Depending on the beam desired, energy is fed in either through a port 31 or a port 33 for the aperture 17 and is fed in either through a port 35 or a port 37 for the aperture 15. In order to achieve frequency compensation in the transverse direction, a corporate feed is desirable. Thus, it is preferred that the antenna structure shown on FIG. 7 be used.

As previously indicated the antenna is a printed antenna such as a micro-strip antenna. Thus, it includes an insulating substrate 51 which, in the beginning, is completely covered with conductive material such as copper. The desired antenna pattern is then etched onto the conductor. The antenna shown contains four corporate feed structures which feed energy in parallel. The port for beam no. 1, a beam which is directed forward and to the left is designated 53, that for beam 2 which is directed forward and to the right, 55, that for beam 3 which is directed aft and to the right, 57 and that for beam 4 which is directed aft and to the left as 59. In this embodiment, 16 identical radiating arrays 61 are provided on the left and 16 identical arrays 63 on the right. The arrays 61 on the left are used to generate a backward firing beam whereas those on the right generate a forward firing beam. Each of the arrays 61 can be made of 16 elements spaced 0.486 in. apart with symmetrical conductance about the center of the array. Similarly, the arrays 63 can be made with 12 elements spaced 0.678 in. apart with symmetrical conductances about the center of the array. The conductances for the 16 element arrays 61 are given in Table I below and those for the 12 element array in Table II below.

TABLE 1

Design Conductances For a 16 Element Array (23 DB Tchebycheff Function Over One Half Of The Array)

| Element Number | Conductance |
|---|---|
| 1 & 16 | .055 |
| 2 15 | .030 |
| 3 14 | .052 |
| 4 13 | .081 |
| 5 12 | .120 |
| 6 11 | .169 |
| 7 10 | .235 |
| 8 9 | .330 |

Insertion Loss = −9.23 DB

TABLE 2

Design Conductances For a 12 Element Array (23 DB Techebycheff Function Over One Half Of The Array)

| Element Number | Conductance |
|---|---|
| 1 & 12 | .048 |
| 2 11 | .046 |
| 3 10 | .088 |
| 4 9 | .147 |
| 5 8 | .225 |
| 6 7 | .330 |

Insertion Loss = 7.64 DB

The different conductances are obtained in conventional fashion through a variation in the size of the separate elements. Reference to FIG. 4 will shown how each of the individual elements 71 have different sizes. The elements in each of the arrays 61 and 63 would look essentially the same as shown on FIG. 4. The different spacing for the individual elements in the two different arrays, 61 and 63, is a direct result of the requirements placed on the array depending on whether or not it is forward firing or backward firing, i.e., the spacing is necessary to obtain the necessary phase shift from element to element in order to get the proper beam direction.

Figure 8:
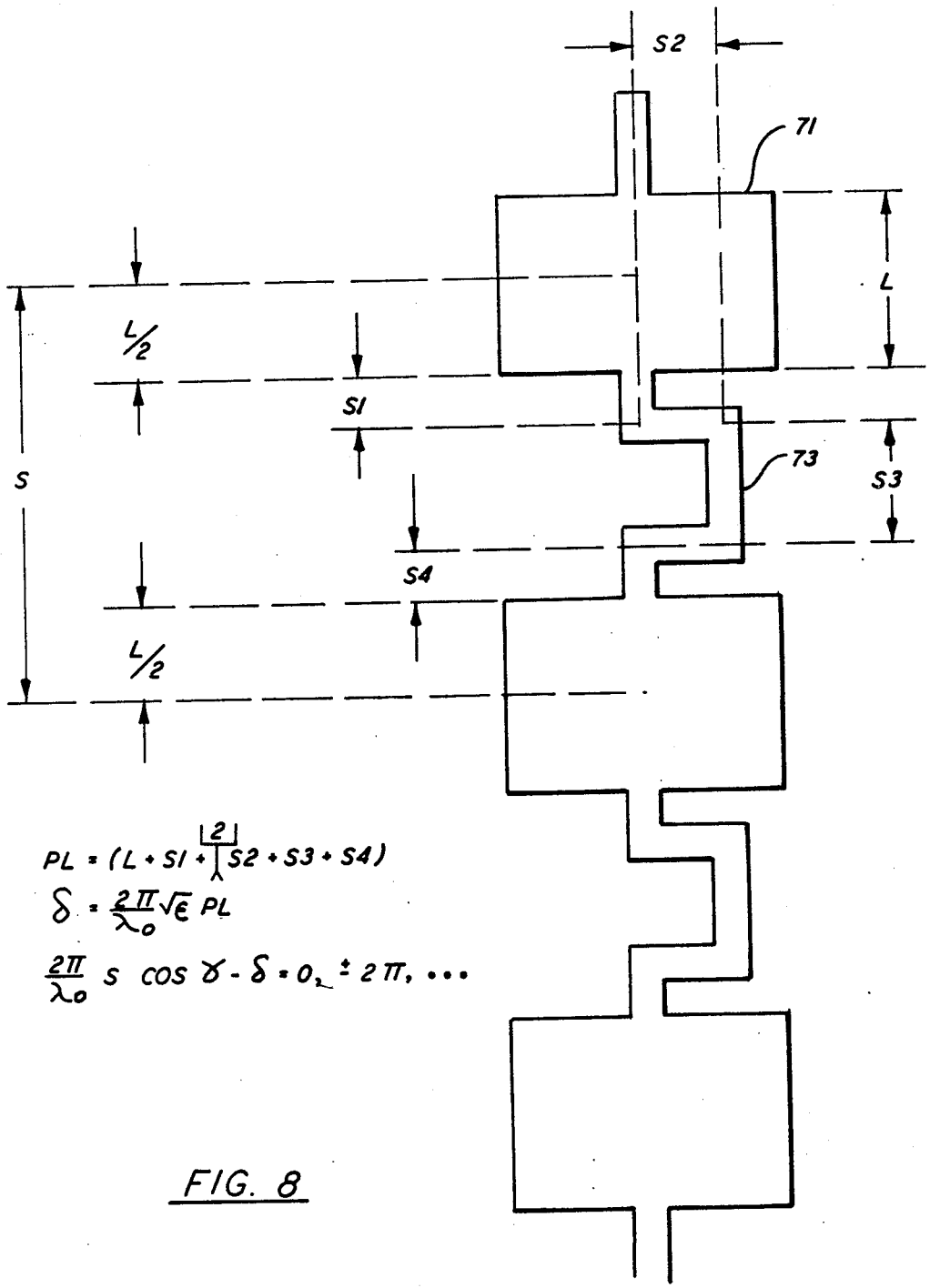
FIG. 8 is a diagram illustrating the manner in which the spacing in both the backward and forward firing arrays can be made an arbitrary distance and the same for both.

It has always been thought that it was necessary to actually space the elements apart in this manner. However, in accordance with a further feature of the present invention in a modification of the embodiment of FIG. 7, both the arrays 61 and the arrays 63 can be made with an identical number of elements 71 as shown on FIG. 8. In accordance with this feature of the present invention, the spacing is made arbitrary and in such a manner as to obtain a maximum number of elements in the alotted space, since this will result in maximum efficiency. In oder to obtain the necessary phase relationship between different elements, the conductor 73 between elements 71 is given a squiggle such that the total distance travelled, i.e., the distance $PL=L+S1+2S2+S3+S4$ is equal to the required spacing between elements.

In other words, with this feature, all of the arrays can be 16 element arrays with the conductances given in Table I. The difference would be that the sum PL for the arrays 63 would be made to be equal to 0.678 and that for the arrays 61 0.486 inches apart. This then maximizes the number of elements in a given area which is alotted to the antenna.

In general terms, this method is applicable to any antenna. With the present antenna, the desired spacing was determined by conventional antenna analysis based on the type of beam it was desired to generate, with respect both to shape and forward or backward firing. Similarly in another antenna, once the dimensions thereof are determined, an arbitrary spacing can be selected so as to place the maximum number of elements in the array, the desired distance between elements to obtain the necessary beam shape then computed, and the squiggles used to achieve the necessary phase shift, i.e, by making the length, with the squiggles, equal to the calculated spacing between elements.

We claim:

1. In a planar antenna, adapted for use in Doppler navigation, the antenna aperture slanted such as to obtain a beam shape which essentially eliminates overwater shift, the antenna being made up of two groups of arrays, the first of which is adapted to generate one set of diagonal beams forward and to the left and aft and to the right and the second of which is adapted to generate another set of diagonal beams forward to the right and aft and to the left, a method of providing fore-aft frequency compensation comprising constructing each array in said first group of arrays from a plurality of elements in series, said elements electrically spaced apart in such a manner so as to obtain phase shifts therebetween which will result in an array which has a beam pointing in the direction in which input energy is fed to form forward firing arrays and constructing the arrays of said second group of arrays from a plurality of elements in series electrically spaced apart so as to establish a phase difference between successive elements which will result in generating a beam which points in a direction opposite to the direction in which energy is fed to said arrays to thereby establish backward firing arrays.

2. The method according to claim 1 and further including the step of feeding said first and second groups of arrays with a corporate feed in order to achieve transverse frequency independence.

3. The method of claim 1 and further including constructing said antenna as a printed antenna by placing individual elements in each of said arrays at a fixed arbitrary spacing from each other such as to place the maximum number of elements possible within a given space; calculating, based on the desired beam, the required spacing between elements to obtain a necessary phase shift therebetween; and connecting said elements with conductors following a squiggle path which has an overall length equal to said calculated distance.

4. The method according to claim 3 wherein identical spacings are used in both the forward and backward firing arrays with the differences in required spacing taken up by said squiggled conductors.

5. An improved printed micro-wave planar antenna comprising:

(a) an planar insulating substrate having a central axis;

(b) a first plurality of identical radiating arrays disposed in a slanted configuration, on said insulating substrate on one side of said central axis, each array comprising a plurality of printed elements with equal spacing said elements electrically spaced apart in such a manner so as to obtain phase shifts therebetween which will result in an array which has a beam pointing in the direction in which input energy is fed to form forward firing arrays;

(c) a second plurality of identical radiating arrays on said planar substrate on the other side of said axis, slanted in a direction opposite to that of the first plurality of arrays, the second plurality being equal in number to the first plurality and each array therein containing a second number of elements equally spaced apart so as to establish a phase difference between successive elements which will result in generating a beam which points in a direction opposite to the direction in which energy is fed to said arrays to thereby establish backward firing arrays; and (d) means for feeding energy to said first and second sets of arrays.

6. Apparatus according to claim 5 wherein said antenna is adapted to generate four beams for use in Doppler navigation and wherein said means for feeding comprise first, second third and fourth corporate feed structures, the first corporate feed structure coupled to said first plurality of arrays at one end thereof, said second corporate feed structure coupled to said first plurality of arrays at the other end thereof, said third corporate feed structure coupled to said second plurality of arrays at one end thereof, and said fourth corporate feed structure coupled to said second plurality of arrays at the other end thereof.

7. An antenna according to claim 6 wherein each array in said first and second plurality of arrays contains an equal number of elements, the elements in each array being at equal spacing and wherein the conductors between elements in each array follow a squiggle path having a distance equal to the calaculated required spacing between elements to generate a desired beam direction.

8. An antenna according to claim 5 wherein said antenna is a micro-strip antenna.

9. In a planar antenna which includes first and second slanted sets of radiating arrays adapted to generate four beams for use in Doppler navigation including a forward left beam, a forward right beam, an aft right beam and an aft left beam, one array set generating said forward left beam and aft right beam and the other generating the forward right and aft left beams, the improvement comprising each array in said first set of arrays being a plurality of elements in series, said elements electrically spaced apart in such a manner so as to obtain phase shifts therebetween which will result in an array which has a beam pointing in the direction in which input energy is fed to form forward firing arrays and the arrays of said second set of arrays being a plurality of elements electrically spaced apart so as to establish a phase difference between successive elements which will result in generating a beam which points in a direction opposite to the direction in which energy is fed to said arrays to thereby establish backward firing arrays to thereby achieve operation which is essentially independent of frequency.

* * * * *